United States Patent [19]

Wells

[11] Patent Number: 4,862,531

[45] Date of Patent: Sep. 5, 1989

[54] BEDDING FOUNDATION HAVING SNAP-IN PLACE FORMED WIRE SPRINGS

[75] Inventor: Thomas J. Wells, Carthage, Mo.

[73] Assignee: Leggett & Platt, Incorporated, Carthage, Mo.

[21] Appl. No.: 144,810

[22] Filed: Jan. 15, 1988

[51] Int. Cl.[4] ..... A47C 23/04

[52] U.S. Cl. ..... 5/247; 5/255; 5/267; 5/272; 5/277; 267/103

[58] Field of Search ..... 5/247, 255, 267, 268, 5/272, 273, 276, 277, 476; 267/80, 86, 95, 100, 103–109

[56] References Cited

U.S. PATENT DOCUMENTS

| | | | |
|---|---|---|---|
| 3,754,249 | 8/1973 | Giampa et al. | 267/108 X |
| 3,825,960 | 7/1974 | Inman et al. . | |
| 3,833,948 | 9/1974 | Surletta et al. . | |
| 3,835,485 | 9/1974 | Klicki . | |
| 3,957,903 | 5/1976 | Lawrence et al. | 5/276 X |
| 3,990,121 | 11/1976 | Whitaker . | |
| 4,101,993 | 7/1978 | Yates et al. | 5/267 |
| 4,426,070 | 1/1984 | Garceau et al. | 5/267 X |
| 4,577,841 | 3/1986 | Hagemeister | 5/255 X |
| 4,704,752 | 11/1987 | Yates et al. . | |

*Primary Examiner*—Michael F. Trettel

*Attorney, Agent, or Firm*—Wood, Herron & Evans

[57] ABSTRACT

A box spring assembly includes a base frame, a top wire grid and a plurality of formed wire springs interconnecting the top wire grid and the base frame. The formed wire springs each comprises a wire strip formed into an inverted U-shaped configuration with the closed end of each U-shaped spring attached to the top wire grid by a snap-fit connection and the free ends at the bottom of the U-shaped spring being attached to the base frame.

12 Claims, 4 Drawing Sheets

BEDDING FOUNDATION HAVING SNAP-IN PLACE FORMED WIRE SPRINGS

This invention relates to bedding foundations, and more particularly, to a box spring style of bedding foundation.

Prior art box springs or bedding foundations have generally included coil springs positioned in a vertical orientation so as to provide resilient support for a bedding mattress. In an effort to improve upon these conventional coil spring types of box spring or bedding foundation assemblies, numerous prior art assemblies have been developed which substitute formed wire springs for the more traditional coil springs. "Formed wire" springs is a term of art used to describe springs which derive their resiliency from torsion bars rather than coils. Examples of formed wire springs embodied in box spring assemblies are to be found in U.S. Pat. Nos. 3,825,960; 3,833,948; and 3,835,485. Additionally, some prior art box spring assemblies have been developed which included combinations of coil and formed wire springs, as for example, the box spring assembly shown in U.S. Pat. No. 3,990,121. In those instances wherein formed wire springs and coil springs have been combined in a box spring, the formed wire springs have usually functioned to impart additional firmness to selected areas of the box spring, as for example, around the edge of the box spring or in the center section of the box spring.

Box springs which utilize formed wire springs for imparting resiliency to the product generally include a base frame, an upper wire grid, and a plurality of formed wire springs extending between the base and the wire grid. A characteristic of nearly all such formed wire box springs is that they are relatively expensive and time consuming to assemble. The assembly time and expense is primarily attributable to the attachment of the tops of the springs to the wire grid in such a fashion that the springs will not later work themselves loose from the grid.

It has therefore been an objective of this invention to provide an improved box spring which utilizes a novel formed wire spring and wire grid which may more quickly and less expensively be assembled to create an assembled box spring which is not subject to inadvertent breakage or separation of the springs and the grid.

Still another objective of this invention has been to provide an improved box spring which has all of the resiliency and selective firmness characteristics of prior art box springs, but which may be manufactured and sold substantially less expensively than prior art box springs of the same resiliency and firmness characteristics.

The improved box spring of this invention comprises formed wire springs, each spring of which has a flat, horizontal, U-shaped top or head section from the opposite ends of which a pair of resilient legs extend vertically downwardly to a base section which is attached to the base frame of the box spring. According to the practice of this invention, the flat, horizontal, U-shaped heads of the springs are snap-fit and locked into rectangular pockets of the top wire grid so that there is no need for metal clips or other formed connectors for securing the sinuous wire springs to the grid. In order to snap-fit and lock the springs to the grid, two opposed parallel sides of the flat, horizontal, U-shaped head of each spring have sections thereof resting over a pair of opposed parallel grid wires, and a connecting bar of the U-shaped head extends beneath an upwardly offset section of a third grid wire which extends perpendicular to the parallel grid wire. In order to lock the spring within the pocket of the grid, the upwardly offset section of the third grid wire has a detent extending downwardly therefrom for a distance greater than the diameter of the wire from which the spring is manufactured. This detent prevents the flat, horizontal, U-shaped head of the spring from sliding horizontally and inadvertently releasing from the pocket into which it is snap-fit.

Yet another aspect of this invention is predicated upon an improvement which markedly increases the firmness of a torsion bar type of formed wire spring without substantially increasing the cost of that spring. In the assignee's co-pending U.S. patent application Ser. No. 834,903, filed Feb. 28, 1986, now U.S. Pat. No. 4,704,752 there is disclosed a formed wire spring which has some characteristics in common with the formed wire spring of this application. That formed wire spring, as does the spring of this application, has a pair of generally vertically extending resilient legs which terminate at the bottom in torsion bars which rest upon and are secured to the base frame of the box spring. In accordance with one aspect of this invention, these lowermost torsion bars have feet which extend inwardly toward one another from their respective torsion bars and are fixedly, as by welding, received together. This securement or locking together of the foot extensions of the lowermost torsion bars of the resilient legs of the springs has been found to markedly and very inexpensively increase the firmness of the springs over identical springs which do not have the foot extensions locked or welded together.

The invention of this application provides a box spring which may be assembled substantially less expensively than box springs upon which this invention is an improvement, such as the box spring disclosed in the above-identified U.S. patent application Ser. No. 834,903. It also has the advantage of being a substantially firmer box spring than the unit upon which it is an improvement.

These and other objects and advantages of the present invention will be more readily apparent from the following description of the drawings, in which.

Figure 1:
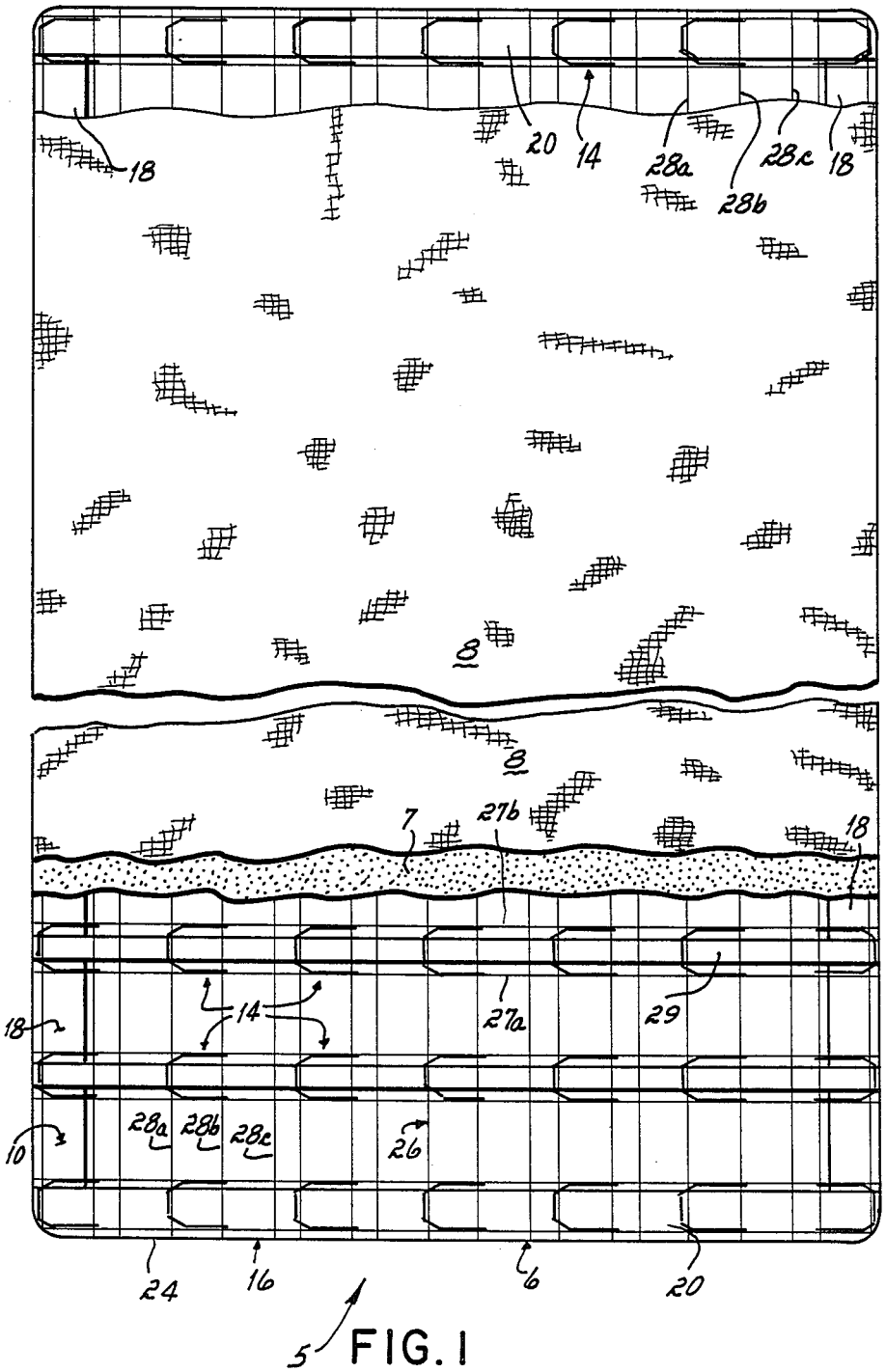
FIG. 1 is a top plan view, partially broken away, of a box spring incorporating the invention of this application.
Figure 2:
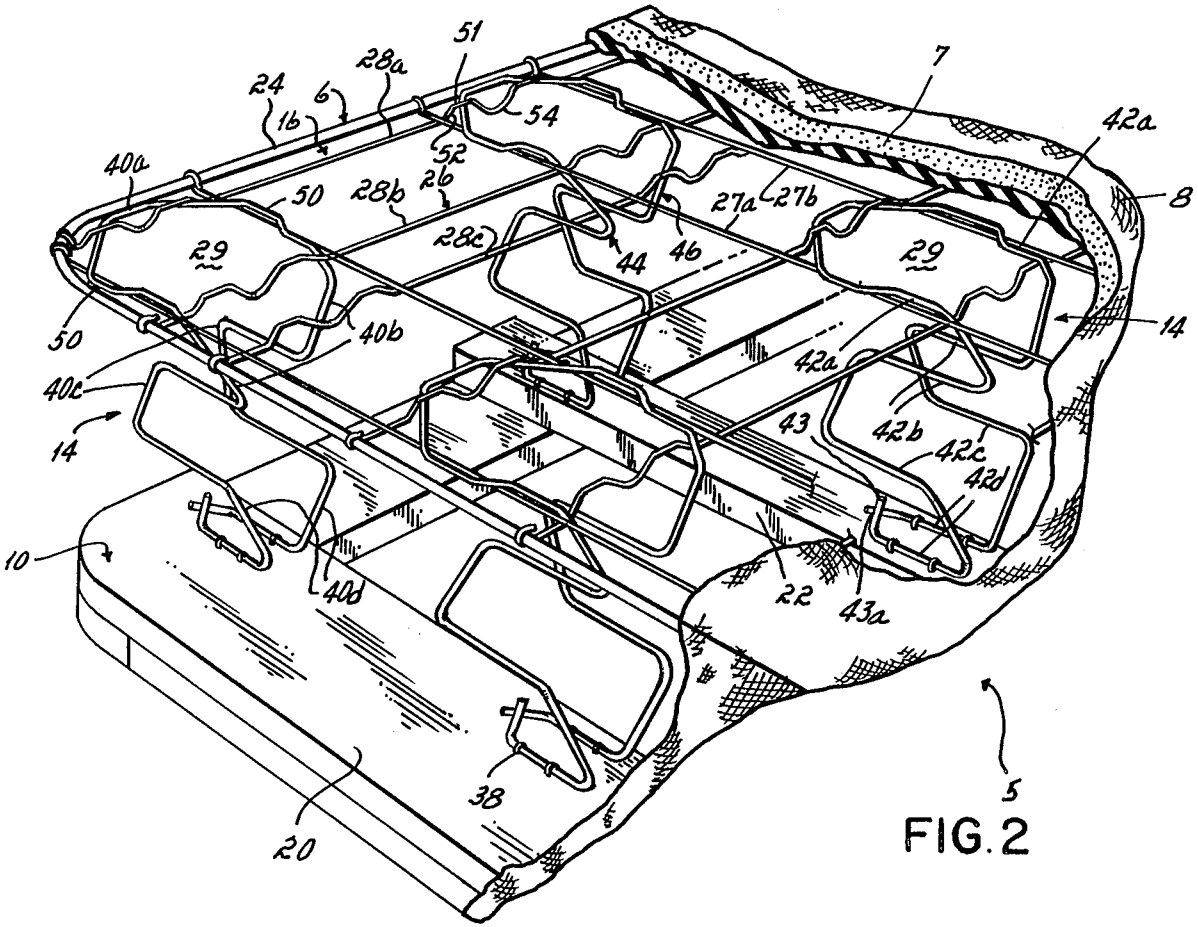
FIG. 2 is a perspective view of one corner portion of the box spring assembly of FIG. 1.
Figure 3:
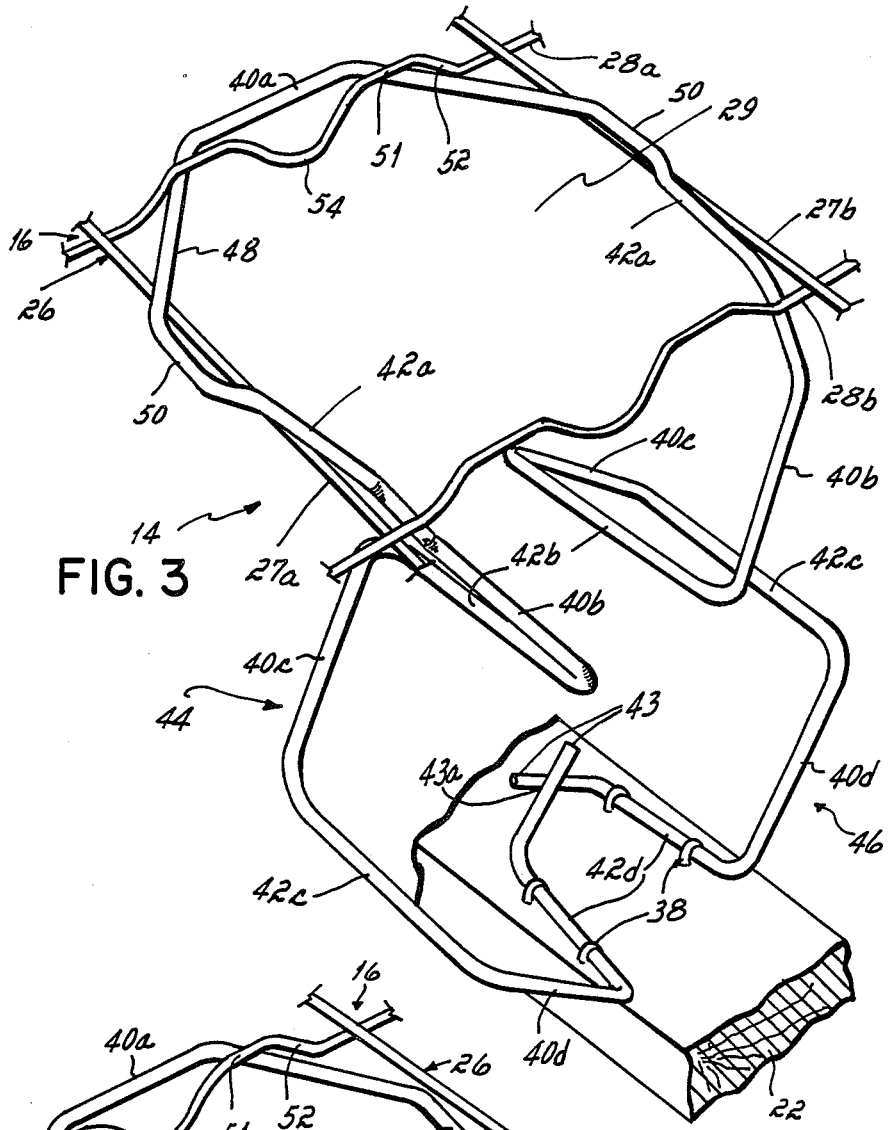
FIG. 3 is an enlarged perspective view of one portion of the box spring assembly of FIG. 2.

With reference first to FIGS. 1–3, it will be seen that the bedding foundation or box spring 5 of this invention includes a box spring assembly 6 over the top of which padding 7 is placed. The box spring assembly 6 and padding 7 are encased in an upholstered covering 8.

The box spring assembly 6 comprises a wooden base frame 10 upon the top of which there is mounted a plurality of formed wire springs 14 for supporting a top wire grid 16. The top wire grid 16 is intended to resiliently support a mattress, as is conventional in the bedding industry.

The base frame 10 is rectangular in configuration and comprises a pair of longitudinally extending side boards 18 (FIG. 1), as well as a pair of transversely extending end boards 20, nailed or otherwise secured to the top of the side boards 18. Additionally, there are a plurality of wooden slats 22 which extend transversely across the rectangular base between the side boards 18. These slats are also nailed or otherwise fixedly secured to the top of the side boards 18.

The top wire grid assembly 16 comprises a border wire 24 and a welded wire grid 26. The border wire 24 is formed into a rectangular configuration and overlies the peripheral edge of the rectangular base frame. The welded wire grid 26 is secured to and located in the plane of the border wire 24, the grid and border wire defining the top plane of the box spring assembly. The welded wire grid 26 comprises a plurality of spaced, transverse wires 27 and a plurality of spaced, longitudinal wires 28. The transverse wires 27 are arranged in pairs 27*a*, 27*b*, and except for intervening reinforcement wires 28*c*, the longitudinal wires 28 are similarly arranged in pairs 28*a*, 28*b*. All of the wires 27 and 28 of the welded wire grid 26 extend between opposite sides and ends, respectively, of the rectangular border wire 24. These grid wires overlie the rows and columns of formed wire springs 14 so as to secure the top of those springs 14 against lateral and longitudinal displacement. The edgemost ones of the transverse wires 27 and longitudinal wires 28 lie in close adjacency and parallel to the border wire so as to provide edge support of the border wire from the springs 14 which are snap-fit into pockets of the wire grid defined by these edgemost wires as explained more fully hereinafter.

The ends of all the grid wires 27, 28 are hooked around the border wire 24 and are preferably welded to the border wire. The intersections or cross-over points of the transverse wires 27 and the longitudinal wires 28 are welded together, thereby providing a matrix of pockets 29 contained within an integral welded wire top grid. In manufacture, the border wire 24 and the welded wire grid 26 are all preformed into a welded top wire grid 16 subassembly.

The top wire grid 16, including the four radiused corners, is connected to the wooden frame by the formed wire springs 14. With particular reference to FIGS. 2 and 3, it will be seen that each of these formed wire springs 14 comprises a wire spring strip made from wire bent back and forth upon itself into a generally square, wave-shaped form so as to have connector bar sections 40 interconnected by straight torsion bar sections 42. According to the practice of this invention, each of these square, wave-shaped strips is formed into a generally inverted U-shaped configuration having substantially vertical legs 44, 46 interconnected at the top by a substantially flat, U-shaped top section 48. The substantially flat top section 48 of each spring comprises a generally C-shaped connector bar 40*a* and a pair of torsion bar sections 42*a* extending from the opposite ends of the connector bar 40*a*. The ends of these two torsion bar sections 42*a* remote from the connector bar 40*a* are connected to the vertical legs 44, 46 of the spring. In the practice of this invention, the torsion bars 42*a* each have an outwardly extending offset 50 formed therein.

Each vertical leg comprises three connector bars 40*b*, 40*c* and 40*d* interconnected by a pair of straight torsion bar sections 42*b*, 42*c*. The uppermost connector bar 40*b* slopes downwardly and inwardly from the top torsion bar 42*a* to the torsion bar 42*b*. The second connector bar 40*c* slopes downwardly and outwardly from the torsion bar 42*b* to the torsion bar 42*c*, and the bottommost connector bar 40*d* slopes downwardly and inwardly to the lowermost torsion bar 42*d*. The bottommost torsion bar 42*d* is connected to the base frame 10 by staples 38.

In the preferred practice of this invention, the connector bars 40*b*, 40*c* and 40*d* are of the same length and are of lesser length than the generally C-shaped top connector bar 40*a* of the flat top section 48 of the springs 14. In one practice of the invention, the three connector bars 40*b*, 40*c* and 40*d* of the vertical legs 44, 46 of the springs are each approximately 5.0 centimeters in length, and the C-shaped connector bar 40*a* of the top section of the springs is approximately 11.0 centimeters in length. The torsion bars 42*b* and 42*c* are approximately 5.0 centimeters in length, and the torsion bar 42*d* is approximately 3.0 centimeters in length. The vertical legs 44, 46 of the springs 14 are, in the preferred practice of this invention, each displaced from a vertical plane through the torsion bars 42*a* by approximately 15° . In other words, both legs 44, 46 slope inwardly from the torsion bars 42*a* toward one another such that the torsion bars 42*a* are spaced apart approximately 7.5 centimeters, and the bottom torsion bars 42*d* of each sinuous spring 14 are spaced apart by approximately 3.0 centimeters. The springs 14 are approximately 14 centimeters in height.

All of the sinuous wire springs 14 are attached at the bottom to the end boards 20 or slats 22 of the base frame by staples 38 over the torsion bars 42*d*. Preferably, free ends 43 extend upwardly and inwardly from the ends of the bottom torsion bars 42*d* and are welded together at their intersections 43*a*. At the top, all of the sinuous springs are attached to the grid 16 by having the substantially flat top sections 48 of the springs snap-fit into pockets 29 of the grid defined by intersecting pairs of transverse wires 27*a*, 27*b* and longitudinal wires 28*a*, 28*b*. To facilitate this snap-fit interconnection of the top sections 48 of the sinuous springs 14 within the pockets 29 of the welded wire grid, it will be noted in FIGS. 3 and 4 that the longitudinal wires 28 pass beneath the transverse wires 27 at the intersections thereof. Between the transverse wires 27, the longitudinal wires 28 have upwardly extending, vertical offsets 51 formed therein. These offsets 51 are preferably of approximately the same height as the diameter of the wire from which the sinuous springs 14 are formed. The length of the offsets 51 is slightly greater than the width of the portion of the C-shaped connector bar 40*a* received beneath the offset. As a result of this formation of the offsets 51, the connector bar 40*a* of the top flat section 48 of the spring 14 is entrapped beneath and between the edges 52 of the vertical offset section 51 of the longitudinal wires 28. To ensure that the substantially flat top section 48 of the sinuous springs 14 does not slip out of the pockets 29 of the wire grid within which it is entrapped, the longitudinal wires 28 have a V-shaped indentation 54 formed therein mid-length of the vertical offset 51. This V-shaped indentation 54 extends downwardly from the longitudinal wire 28 in a vertical plane to a depth at least twice, and preferably three times, the diameter of the wire from which the spring 14 is formed.

Figure 4:
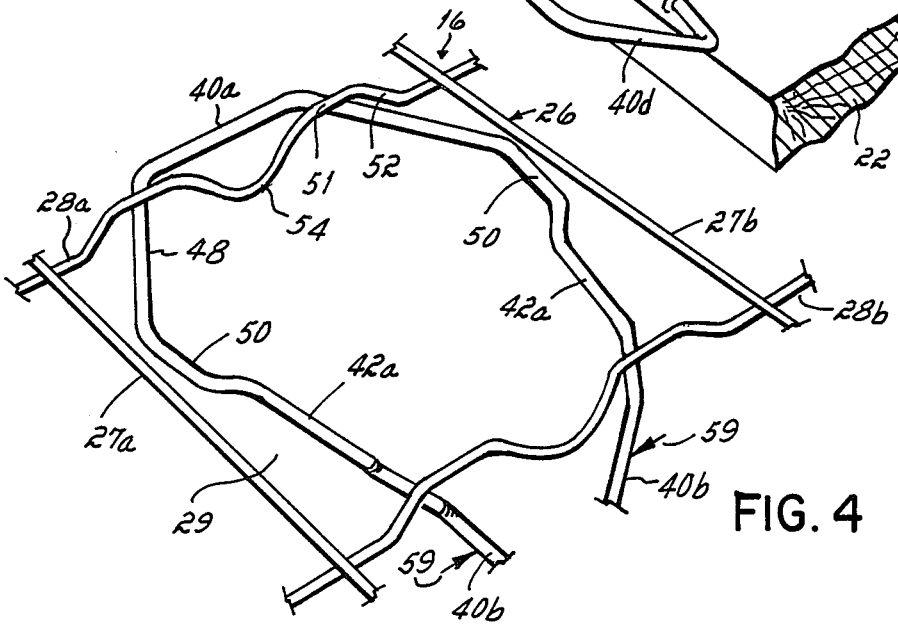
FIG. 4 is a view similar to FIG. 3 illustrating how a top of a sinuous wire spring is snap-fit into a pocket of a welded wire grid in accordance with the practice of this invention.
Figure 6:
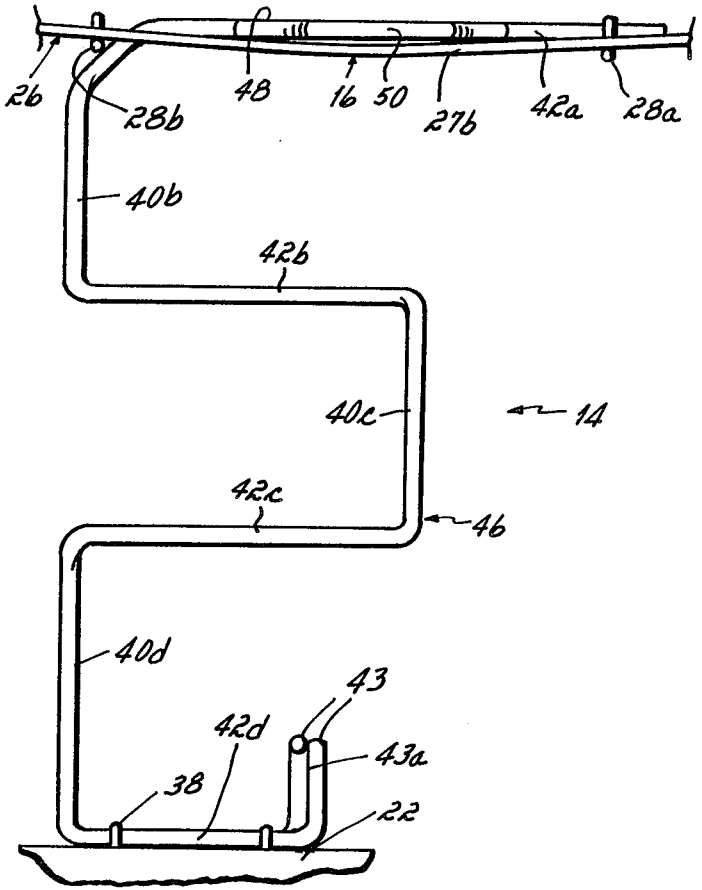
FIG. 6 is a side elevational view of the portions of the box spring assembly illustrated in FIG. 3.
Figure 5:
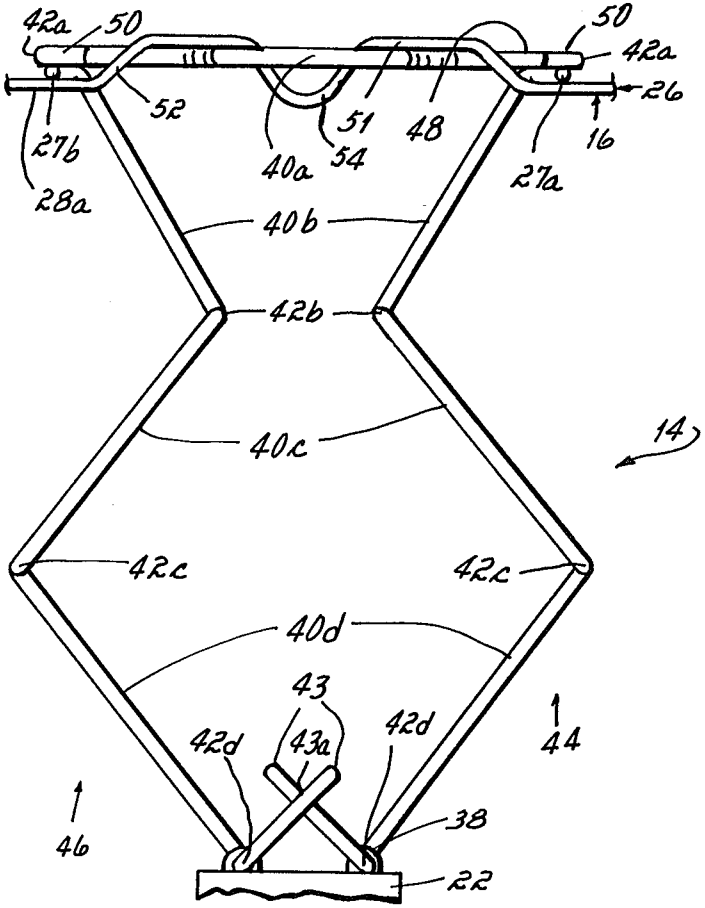
FIG. 5 is an end elevational view of the portion of the box spring assembly illustrated in FIG. 3.

To assemble the springs 14 with the grid 16, the flat top sections 48 of the sinuous springs 14 are snap-fit into the pockets 29 of the grid by simply squeezing together the top connector bars 40*b* of the vertical legs 44, 46, as indicated by the arrows 59 in FIG. 4, until the outwardly extending offsets 50 of the torsion bars 42*a* are located internally of the transverse wires 27*a* and 27*b*. The connector bars 40*b* of the legs 44, 46 are then lifted upwardly until the horizontal offsets 50 are positioned above the wires 27*a*, 27*b*. When so positioned, the force used to squeeze the connector bars 40*b* together is relieved such that the horizontal offset sections 50 snap out over the transversely extending wires 27*a*, 27*b*. Because the connector bar 40*a*. of the substantially flat top section 48 of the spring is then located beneath the longitudinal wire 28*a*, the top loop of the sinuous spring is then fixedly attached to the wire grid. The sinuous spring 14 is then locked to the grid as a consequence of this snap-fit interconnection between the wires of the grid and the substantially flat top planar section of the spring.

In practice, the box spring of FIGS. 1–3 is assembled by first nailing the end boards 20 to the tops of the side boards 18 and by nailing the slats 22 to the tops of these same side boards The preassembled top wire grid 16 having the springs 14 mounted therein is then fitted over the top of the assembled wooden frame so as to position the bottom section torsion bars 42*d* of the sinuous wire springs atop the base frame. The bottom free end torsion bars 42*d* of the sinuous wire springs 14 are then stapled to the tops of the end boards 20 and the ends of the slats 22.

It is important to note that the edgemost longitudinal and transverse grid wires which partially define the pockets 29 for the edgemost springs 14, are located closely adjacent the border wire 24. In practice, these edgemost grid wires extend parallel to the grid wire but are spaced approximately two centimeters from the border wire 24. The need for this close adjacency positioning of the edgemost grid wires derives from the fact that the border wire is made from such heavy gauge or large diameter wire or rod that it is not suitable for snap-fit connection with the edgemost springs 14. By locating the edgemost grid wires in close adjacency, but spaced from, the border wire, the springs 14 may be snap-fit thereto while still providing vertical edge support for the closely spaced border wire. The edgemost grid wires thus act as an inner border wire extending parallel to, but slightly spaced from, the border wire 24, but of much smaller diameter wire suitable for snap-fit connection with the heads of the springs 14.

It is also important to note that the free ends 43 of the bottom torsion bars 42*d* extend upwardly and inwardly to cross and are welded together at the crossing point or intersection 43*a*. By so connecting the lower ends of the legs 44, 46 of the springs 14, the springs are rendered substantially more firm than if the free ends 43 are not secured together.

To complete the foundation after completion of the box spring assembly, the fabric pad 7 is overlaid over the top of the welded wire grid and the complete assembly, including the rectangular wooden frame, the springs, the top wire grid, and the fabric pad, are enclosed within the upholstered covering 8.

While we have described only one preferred embodiment of our invention, persons skilled in this art will appreciate changes and modifications which may be made without departing from the spirit of my invention. For example, the relative positioning of the snap-fit sinuous wire springs in the box spring assembly may be varied without departing from my invention, or those sinuous wire springs may be mixed with coil springs or other modular springs at selected sites in the assembly. Therefore, we do not intend to be limited except by the scope of the following appended claims.

We claim:

1. A bedding foundation comprising, a bottom, substantially rectangular, horizontal base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being fixedly connected to said border wires, pairs of said longitudinally extending wires and pairs of said transversely extending wires defining rectangular pockets for the reception of formed wire springs, a plurality of formed wire springs interconnecting said base frame and said wire grid, each of said formed wire springs comprising a single length of wire of a first diameter, said length of wire being formed into a pair of substantially vertical resilient legs interconnected by a flat, horizontal, U-shaped section, said flat, horizontal, U-shaped section of each of said formed wire springs being secured within one of said pockets of said wire grid and the ends of said vertical legs of each of said formed springs remote from said flat, horizontal, U-shaped section being fixedly secured to said base frame, said flat, horizontal, U-shaped section of each of said formed wire springs including a pair of parallel torsion bars each connected at one end to opposite ends of a connector bar and each connected at the opposite end to one of said vertical legs, said torsion bars and said connector bar being substantially coplanar, said flat, horizontal, U-shaped section being connected to said top wire grid by snap-fit connector means, said snap-fit connector means comprising portions of each torsion bar of said pair of torsion bars of said flat, horizontal, U-shaped section being spring-biased outwardly over a straight portion of each of a pair of wires of one of said first and second sets of wires of said grid and a portion of said connector bar of said flat, horizontal, U-shaped section being located beneath an upwardly offset section of one wire of the other of said first and second sets of wires of said grid, said upwardly offset section of said one wire having a downwardly extending depression formed therein for locking said flat, horizontal, U-shaped section of said formed wire spring within said pocket, a fabric pad overlying said top wire grid, and an upholstered covering surrounding said base frame, to wire grid, sinuous wire springs, and said fabric pad.

2. A bedding foundation assembly comprising, a bottom, substantially rectangular, horizontal base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being fixedly connected to said border wires, pairs of said longitudinally extending wires and pairs of said transversely extending wires defining rectangular pockets for the reception of formed wire springs, a plurality of formed wire springs interconnecting said base frame and said wire grid, each of said formed wire springs comprising a single length of wire of a first diameter, said length of wire being formed into a pair of substantially vertical resilient legs interconnected by a flat, horizontal, U-shaped section, said flat, horizontal, U-shaped section of each of said formed wire springs being secured within one of said pockets of said wire grid and the ends of said vertical legs of each of said formed springs remote from said flat, horizontal, U-shaped section being fixedly secured to said base frame, and said flat, horizontal, U-shaped section of each of said formed wire springs including a pair of parallel torsion bars each connected at one end to opposite ends of a connector bar and each connected at the opposite end to one of said vertical legs, said torsion bars and said connector bar being substantially coplanar, said flat, horizontal, U-shaped section being connected to said top wire grid by snap-fit connector means, said snap-fit connector means comprising portions of each torsion bar of said pair of torsion bars of said flat, horizontal, U-shaped section being spring-biased outwardly over a straight portion of each of a pair of wires of one of said first and second sets of wires of said grid and a portion of said connector bar of said flat, horizontal, U-shaped section being located beneath an upwardly offset section of one wire of the other of said first and second sets of wires of said grid, said upwardly offset section of said one wire having a downwardly extending depression formed therein for locking said flat, horizontal, U-shaped section of said formed wire spring within said pocket.

3. The bedding foundation assembly of claim 2 wherein said upwardly offset section of said one wire is offset upwardly from the horizontal plane of said grid by a distance approximately equal to the diameter of the wire from which said formed wire spring is manufactured, and said downwardly extending depression extends downwardly from said offset section for a distance at least equal to said diameter.

4. The bedding foundation assembly of claim 3 wherein said depression extends downwardly from said offset section for a distance at least equal to twice said diameter.

5. The bedding foundation of claim 2 wherein each of said pair of torsion bars of said flat, horizontal, U-shaped section of said formed wire springs comprises a straight bar having an outwardly extending offset formed therein.

6. The bedding foundation of claim 5 wherein said downwardly extending indentation is located approximately medially of the length of said vertically and upwardly offset section.

7. A bedding foundation assembly comprising a base frame, a top wire grid and a plurality of formed wire springs interconnecting the top wire grid and the base frame, said top wire grid having a plurality of rectangular spring receiving pockets, each of said pockets being formed by two intersecting pairs of wires of said top wire grid, said formed wire springs each comprising a single length of wire formed into a pair of substantially vertical resilient legs interconnected at the top by a flat, horizontal U-shaped top section, each of said flat, horizontal U-shaped top sections of said springs being secured within one pocket of said top wire grid, said flat, horizontal, U-shaped section of each of said formed wire springs including a pair of parallel torsion bars each connected at one end to opposite ends of a connector bar and each connected at the opposite end to one of said vertical legs, said torsion bars and said connector bar being substantially coplanar, said flat, horizontal, U-shaped section being connected to said top wire grid by snap-fit connector means, said snap-fit connector means comprising portions of each torsion bar of said pair of torsion bars of said flat, horizontal, U-shaped section being spring-biased outwardly over a straight portion of each of a pair of wires of one of said first and second sets of wires of said grid and a portion of said connector bar of said flat, horizontal, U-shaped section being located beneath an upwardly offset section of one wire of the other of said first and second sets of wires of said grid, said upwardly offset section of said one wire having a downwardly extending depression formed therein for locking said flat, horizontal, U-shaped section of said formed wire spring within said pocket, and each of said vertical resilient legs having lower ends attached to said base frame.

8. The bedding foundation assembly of claim 7 wherein said upwardly offset section of said one wire is offset upwardly from the horizontal plane of said grid by a distance approximately equal to the diameter of the wire from which said formed wire spring is manufactured, and said downwardly extending depression extends downwardly from said offset section for a distance at least equal to said diameter.

9. The bedding foundation assembly of claim 8 wherein said depression extends downwardly from said offset section for a distance at least equal to twice said diameter.

10. The bedding foundation of claim 7 wherein each of said pair of torsion bars of said flat, horizontal, U-shaped section of said formed wire springs comprises a straight bar having an outwardly extending offset formed therein.

11. The bedding foundation of claim 10 wherein said downwardly extending indentation is located approximately medially of the length of said vertically and upwardly offset section.

12. A box spring assembly having a rectangular horizontal frame, a rectangular wire grid parallel to and spaced above said frame, a plurality of wire spring elements each connected between said frame and said grid, said wire grid comprising a rectangular border wire, a plurality of spaced, parallel, longitudinal wires, and a plurality of spaced, parallel, transverse wires, said longitudinal wires and said transverse wires extending between and being attached to opposite sides of said border wire, said longitudinal and transverse wires defining an array of rectangular pockets between adjacent pairs of said longitudinal wires and adjacent pairs of said transverse wires, said spring elements being disposed between said frame and said grid for providing distributed elastic support to a bedding load on said grid, each of said spring elements occupying a single and separate pocket in said array, each of said spring elements being integrally formed of a single and separate wire, and each including a base formed on both ends of said wire, each of said bases comprising a bottom torsion bar resting upon and fastened to said frame, a generally U-shaped head formed in said wire between said ends and fastened to said grid directly above said base, a pair of vertical arms each formed of said wire at opposite sides of said head between said head and said base, and each including a pair of horizontal torsion bars, an angled connecting bar interconnecting one of said torsion bars with said base, an angled connecting bar interconnecting the other one of said torsion bars with said head and an angular connecting bar interconnecting said torsion bars with each other, and said bottom torsion bars both having a foot section extending therefrom, said foot sections extending toward and crossing over one another to form an intersection and being fixedly secured together at said intersection.

* * * * *